US011168885B2

(12) United States Patent
Vie

(10) Patent No.: US 11,168,885 B2
(45) Date of Patent: Nov. 9, 2021

(54) FLAME SENSOR ASSEMBLIES AND METHODS OF REPLACING FLAME SENSOR ASSEMBLIES

(71) Applicant: EMERSON ELECTRIC CO., St. Louis, MO (US)

(72) Inventor: David L. Vie, Union, MO (US)

(73) Assignee: Emerson Electric Co., St. Louis, MO (US)

( * ) Notice: Subject to any disclaimer, the term of this patent is extended or adjusted under 35 U.S.C. 154(b) by 266 days.

(21) Appl. No.: 16/680,071

(22) Filed: Nov. 11, 2019

(65) Prior Publication Data

US 2021/0140636 A1 May 13, 2021

(51) Int. Cl.

| | |
|---|---|
| ***F23N 5/26*** | (2006.01) |
| ***F23N 5/12*** | (2006.01) |
| *F23D 14/72* | (2006.01) |

(52) U.S. Cl.

CPC ..... *F23N 5/26* (2013.01); *F23N 5/123* (2013.01); *F23N 5/126* (2013.01); *F23N 5/265* (2013.01); *F23D 14/725* (2013.01); *F23N 2229/00* (2020.01); *F23N 2229/02* (2020.01); *F23N 2229/22* (2020.01); *F23N 2900/05004* (2013.01); *F23N 2900/05005* (2013.01)

(58) Field of Classification Search

CPC . F23N 5/26; F23N 5/126; F23N 5/265; F23N 5/123; F23N 2900/05004; F23N 2900/05005; F23N 2229/00; F23N 2229/02; F23N 2229/22; F23D 14/725

USPC ..... 431/343, 154, 66, 77, 78, 80

See application file for complete search history.

(56) References Cited

U.S. PATENT DOCUMENTS

| | | | | |
|---|---|---|---|---|
| 2,074,637 A * | 3/1937 | Ballentine | ..... | F23N 5/126 431/78 |
| 2,665,749 A | 1/1954 | Ebeltoft | | |
| RE26,743 E * | 12/1969 | Loveland | ..... | G01K 1/14 136/217 |

(Continued)

FOREIGN PATENT DOCUMENTS

| | | | | |
|---|---|---|---|---|
| DE | 3204047 A1 * | 8/1983 | ..... | F23Q 9/00 |
| JP | 60159517 A * | 8/1985 | ..... | F23N 5/126 |
| JP | 61053525 A * | 3/1986 | ..... | F02B 77/085 |

OTHER PUBLICATIONS

"Google Search—Burner Flame Sensor Replacement Kit Sep. 25, 2021.pdf", Online Search, Google.com, Sep. 25, 2021. (Year: 2021).*

*Primary Examiner* — Steven B McAllister
*Assistant Examiner* — Daniel E. Namay
(74) *Attorney, Agent, or Firm* — Harness, Dickey & Pierce, P.L.C.; Anthony G. Fussner

(57) ABSTRACT

A flame sensor assembly includes a flame sense rod and a flame sensor body. The flame sense rod includes a flame sensor end and a coupling end opposite the flame sensor. The flame sensor body defines a receptacle for receiving the coupling end of the flame sense rod, and includes an adjustable positioning bracket. The assembly also includes a wiring adapter for connecting the flame sensor body with a flame sense signal connector, and a mounting bracket adapted to mount the flame sensor body to a heating device with the flame sensor end of the flame sense rod positioned adjacent a flame of the heating device. Methods of replacing a flame sensor assembly for a heating device are also disclosed.

20 Claims, 4 Drawing Sheets

(56) References Cited

U.S. PATENT DOCUMENTS

| | | | | |
|---|---|---|---|---|
| 4,325,690 | A * | 4/1982 | Hayes | F23Q 9/04 431/78 |
| 5,632,614 | A * | 5/1997 | Consadori | F23N 5/20 431/79 |
| 6,095,797 | A * | 8/2000 | Haddad | F16L 37/008 431/154 |
| 7,223,098 | B2 * | 5/2007 | Suyama | F23Q 3/008 431/259 |
| 7,646,005 | B2 * | 1/2010 | Chase | F23N 5/082 250/554 |
| 7,777,977 | B2 * | 8/2010 | Chase | F23N 5/082 359/820 |
| 9,927,382 | B2 * | 3/2018 | Freymiller | G01N 27/028 |
| 2004/0069246 | A1 * | 4/2004 | Donnelly | F23N 5/105 122/504 |
| 2005/0221244 | A1 * | 10/2005 | Nguyen | F23N 5/107 431/80 |
| 2009/0190186 | A1 * | 7/2009 | Chase | F23N 5/082 358/474 |
| 2009/0207510 | A1 * | 8/2009 | Chase | G01J 5/02 359/820 |
| 2012/0090890 | A1 | 4/2012 | Kraus et al. | |
| 2016/0169823 | A1 * | 6/2016 | Freymiller | F23N 5/12 324/649 |

* cited by examiner

FLAME SENSOR ASSEMBLIES AND METHODS OF REPLACING FLAME SENSOR ASSEMBLIES

FIELD

The present disclosure generally relates to flame sensor assemblies, and methods of replacing flame sensor assemblies.

BACKGROUND

This section provides background information related to the present disclosure which is not necessarily prior art.

Original equipment manufacturer (OEM) gas furnace flame sensors are produced in a wide variety of configurations, using different flame sense rods, different mounting brackets, and different wiring connections, among other differences. This complicates the ability of field service technicians and distributors to maintain correct service parts in stock for the wide variety of configurations of the different OEM flame sensors.

Most flame sensors are sold as OEM direct replacements, which only match a specific OEM flame sensor application. Some replacement flame sensors include a straight rod that may be cut down to shorter lengths. Manufacturers, distributors and service technicians must stock many different flame sensor stock keeping units (SKUs) (e.g., truck stock). This requires unnecessary trips to and from distributors to get the correct part, which wastes time, wastes money, and reduces opportunities for scheduling additional service calls during a work day. Many times a failing flame sensor may not be replaced due to a lack of parts on hand, leading to a follow-up return service call.

DRAWINGS

The drawings described herein are for illustrative purposes only of selected embodiments and not all possible implementations, and are not intended to limit the scope of the present disclosure.

DETAILED DESCRIPTION

Figure 1:
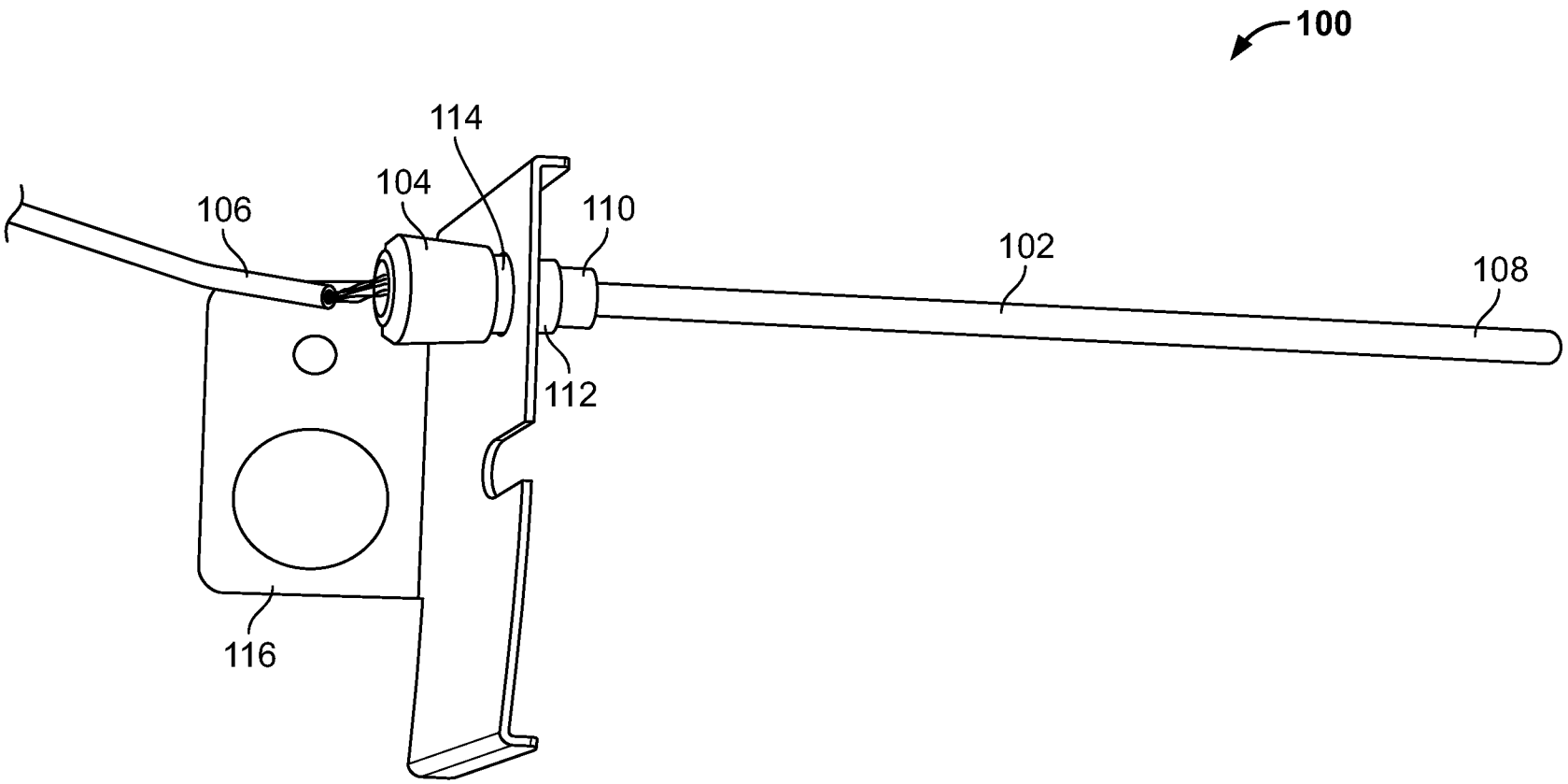
FIG. 1 is a side view of a flame sensor assembly according to an example embodiment of the present disclosure.

Example embodiments will now be described more fully with reference to the accompanying drawings.

Original equipment manufacturer (OEM) gas furnace flame sensors are produced in a wide variety of configurations, using different flame sense rods, different mounting brackets, and different wiring connections, among other differences. This complicates the ability of field service technicians and distributors to maintain correct service parts in stock for the wide variety of configurations of the different OEM flame sensors.

Most flame sensors are sold as OEM direct replacements, which only match a specific OEM flame sensor application. Some replacement flame sensors include a straight rod that may be cut down to shorter lengths. Manufacturers, distributors and service technicians must stock many different flame sensor stock keeping units (SKUs) (e.g., truck stock). This requires unnecessary trips to and from distributors to get the correct part, which wastes time, wastes money, and reduces opportunities for scheduling additional service calls during a work day. Many times a failing flame sensor may not be replaced due to a lack of parts on hand, leading to a follow-up return service call.

Example embodiments described herein include flame sensor assemblies having a flame sense rod, a flame sensor body to accept the flame sense rod, a wiring adapter and a mounting bracket. For example, a universal flame sensor kit for a flame sensor assembly may include multiple screw-in flame sense rods to match multiple OEM flame sense rods (e.g., multiple rods having different lengths, bends, angles, etc. corresponding to popular OEM flame sense rods).

The universal flame sensor kit may include a flame sensor body to accept the different screw-in flame sense rods, where the flame sensor body includes an adjustable positioning bracket. The kit may also include one or more wiring adapters corresponding to different OEM flame sensor assemblies, one or more mounting brackets corresponding to different OEM flame sensor assemblies, other accessories such as assembly materials, instructions and cross-reference information, etc. A universal flame sensor assembly kit may allow a field service technician to easily configure a service replacement part in the field for many or all OEM configurations, saving time and wasted trips looking for parts.

Some example embodiments include a flame sensor assembly having a flame sense rod, a flame sensor body, and a wiring adapter for connecting the flame sensor body with a flame sense signal connector. The flame sense rod includes a flame sensor end and a coupling end opposite the flame sensor end. The flame sensor body defines a receptacle for receiving the coupling end of the flame sense rod, and the flame sensor body includes an adjustable positioning bracket. The flame sensor assembly also includes a mounting bracket adapted to mount the flame sensor body to a heating device, with the flame sensor end of the flame sense rod positioned adjacent a flame of the heating device.

The flame sense rod may be a first flame sense rod which is removable from the flame sensor body to insert a second flame sense rod, where the second flame sense rod has a different shape than the first flame sense rod. Similarly, the first flame sense rod and the second flame sense rod may be removable from the flame sensor body to insert a third flame sense rod, where the third flame sense rod has a different shape than the first flame sense rod and the second flame sense rod.

In some embodiments, the flame sense rod includes a first portion and a second portion, the first portion includes the flame sensor end, the second portion includes the coupling end, and the first portion is bent at an angle with respect to the second portion. For example, the angle may be a ninety degree angle. The coupling end of the flame sense rod may include at least one male thread, and the receptacle of the flame sensor body may include at least one female thread to receive the at least one male thread of the flame sense rod.

The flame sensor body may include a cylindrical body having a longitudinal axis, and the adjustable bracket may include a teardrop bracket defining an opening through which the cylindrical body is received. The teardrop bracket may be movable to multiple positions along the longitudinal axis of the cylindrical body, and may be adapted to clamp at one of the multiple positions along the longitudinal axis to inhibit movement of the teardrop bracket while the teardrop bracket is clamped.

The flame sensor body may be a ceramic body, and the receptacle may be located at a first end of the flame sensor body. The flame sensor body may further include a spade connector located at a second end of the flame sensor body opposite the first end of the flame sensor body. Separately, the mounting bracket may include multiple mounting surfaces, with each mounting surface defining multiple openings for mounting the mounting bracket to different heating devices.

In some embodiments, the flame sense signal connector is a first flame sense signal connector, the wiring adapter is a first wiring adapter having a first wiring connector type for connection to the first flame sense signal connector, and the first wiring adapter is removable from the flame sensor body to connect a second wiring adapter to the flame sensor body. The second wiring adapter may have a second wiring connector type different than the first wiring connector type, to connect the second wiring adapter to a second flame sense signal connector different than the first flame sense signal connector. The flame sensor may be adapted to generate a flame sensor reading current value between two μA and six μA, and the flame sensor assembly may be part of any suitable heating device (e.g., an HVAC system component, a gas furnace, a boiler, a commercial gas dryer, commercial food equipment such as a fryer, a gas pool heater, etc.).

Disclosed herein are example methods of replacing a flame sensor assembly for a heating device. For example, a method may include connecting a flame sense rod to a flame sensor body, where the flame sense rod includes a flame sensor end and a coupling end opposite the flame sensor end, the flame sensor body defines a receptacle for receiving the coupling end of the flame sense rod, and the flame sensor body includes an adjustable positioning bracket.

The method may include connecting a wiring adapter to the flame sensor body for connection with a flame sense signal connector, and mounting the flame sensor body to a heating device using a mounting bracket, with the flame sensor end of the flame sense rod positioned adjacent a flame of the heating device.

In some embodiments, connecting the flame sense rod to the flame sensor body includes screwing the coupling end of the flame sense rod into the receptacle of the flame sensor body. The flame sense rod may be a first flame sense rod, and the method may further include disconnecting the first flame sense rod from the flame sensor body by unscrewing the first flame sense rod from the receptacle of the flame sensor body, and connecting a second flame sense rod to the flame sensor body by screwing the second flame sense rod into the receptacle of the flame sensor body, wherein a shape of the second flame sense rod is different than a shape of the second flame sense rod.

The method may include positioning the flame sensor end of the flame sense rod adjacent the flame of the heating device prior to mounting the flame sensor body to the heating device. Mounting the flame sensor body may include determining an orientation of the mounting bracket that facilitates positioning the flame sensor end of the flame sense rod adjacent the flame of the heating device, prior to mounting the flame sensor body to the heating device. Connecting the wiring adapter to the flame sensor body may include determining which one of multiple wiring adapters includes a wiring connector type corresponding to the flame sense signal connector, and connecting the determined one of the multiple wiring adapters between the flame sensor body and the flame sense signal connector.

Referring now to the Figures, FIG. 1 illustrates a flame sensor assembly 100 according to one example embodiment of the present disclosure. The flame sensor assembly 100 includes a flame sense rod 102, a flame sensor body 104, and a wiring adapter 106 for connecting the flame sensor body 104 with a flame sense signal connector (not shown).

The flame sense rod 102 includes a flame sensor end 108 and at least coupling end 110 opposite the flame sensor end 108. The flame sensor body 104 defines a receptacle 112 for receiving the coupling end 110 of the flame sense rod 102, and the flame sensor body 104 includes an adjustable positioning bracket 114.

The flame sensor assembly 100 also includes a mounting bracket 116 adapted to mount the flame sensor body 104 to a heating device (not shown), with the flame sensor end 108 of the flame sense rod 102 positioned adjacent a flame of the heating device.

The flame sense rod 102 may be removable from the flame sensor body 104 (e.g., by unscrewing the coupling end 110 from the receptacle 112, etc.), to insert a second flame sense rod into the receptacle 112 of the flame sensor body 104, where the second flame sense rod has a different shape than the first flame sense rod 102. For example, the coupling end 110 may include any suitable connector, thread, pin, etc. for removably coupling the flame sense rod 102 to the flame sensor body 104. Therefore, the flame sense rod 102 may be coupled to the flame sensor body 104 via a threaded connection, via a bayonet twist lock connection, via a push-in spring load connection, etc.

This may allow a field service technician to select one of multiple different shaped flame sense rods to replacing flame sensor assemblies in a variety of different OEM configurations. For example, a technician may determine a shape, type, OEM type, etc. of a failed flame sensor assembly, then replace the failed sensor assembly with the flame sensor assembly 100, after selecting an appropriately shaped flame sense rod 102 that corresponds to the shape of the failed flame sensor assembly OEM rod.

Figure 2A:
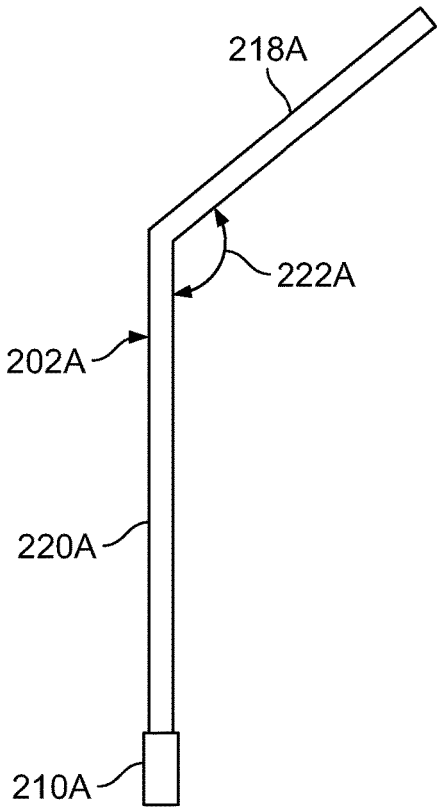
FIGS. 2A-2C are side views of different example flame sense rod configurations for use with the flame sensor assembly of FIG. 1.
Figure 2B:
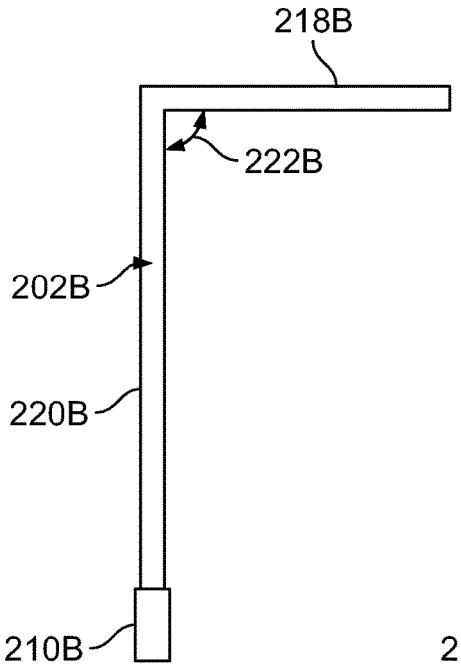
Figure 2C:
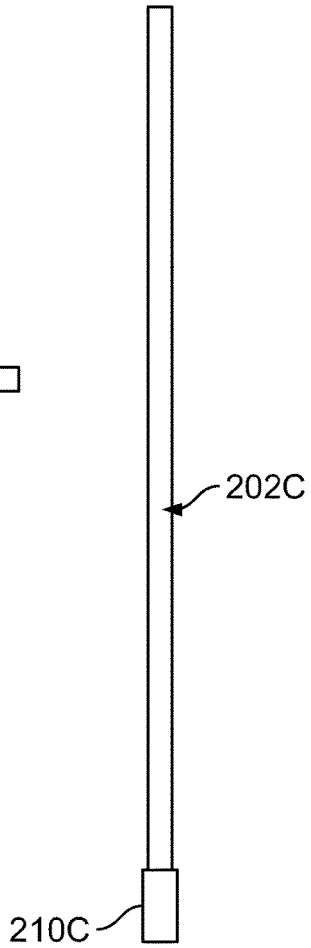

As an example, FIGS. 2A-2C illustrated different shaped flame sense rods 202A, 202B and 202C. The differently shaped flame sense rods 202A, 202B and 202C may each be adapted for insertion into the receptacle 112 of the flame sensor body 104.

For example, the flame sense rod 202A includes a male thread 210A that corresponds to a female thread of the receptacle 112, the flame sense rod 202B includes a male thread 210B that corresponds to the female thread of the receptacle 112, and the flame sense rod 202C includes a male thread 210C that corresponds to the female thread of the receptacle 112.

This may allow a field service technician to select which one of the flame sense rods 202A, 202B and 202C has a shape corresponding to an OEM flame sense rod of a failed OEM flame sensor assembly, and replace the failed assembly with the flame sensor assembly 100 including the appropriate flame sense rod 202A, 202B, or 202C inserted in the receptacle 112 of the flame sensor body 104.

As shown in FIGS. 2A-2C, each flame sense rod 202A, 202B and 202C has a different shape. Specifically, the flame sense rod 202A includes a first portion 218A and a second portion 220A that are bent at an angle 222A with respect to one another. Similarly, the flame sense rod 202B includes a first portion 218B and a second portion 220B that are bent at an angle 222B with respect to one another.

The angles 222A and 222B may be any suitable angles, and may correspond to a location of the heating device flame relative to the flame sensor body 104. For example, the angle 222B of the flame sense rod 202B is a ninety degree angle, while the angle 222A of the flame sense rod 202A is an obtuse angle greater than ninety degrees. Some flame sense rods, such as the flame sense rod 202C, may be straight without any angle.

The different angles 222A, 222B, etc. allow the flame sense rods 202A, 202B and 202C, to correspond to different types of flame sense rods from different OEM, having a variety of different shapes. The different shapes allow the flame sense ends of the rods 202A, 202B and 202C to be positioned adjacent a flame of a heading device, with respect to a mounting location of the flame sensor body 104 that receives the flame sense rod 202A, 202B, or 202C.

Although FIGS. 2A-2C illustrate three flame sense rods 202A, 202B and 202C having approximately similar lengths, other embodiments may include more or less than three rods (e.g., a universal flame sensor kit may include more or less than three rods), other embodiments may include rods having different lengths or different angles, etc.

Each flame sensor rod may include any suitable construction, such as a solid rod including a sensing element, a solid KANTHAL material (e.g., an iron-chromium-aluminum (FeCrAl) alloy), a cylindrical shape having a diameter, etc. The sensor rods may be adapted to produce an output flame sense signal within a specified range, such as between two to six μA, etc. In some embodiments, a flame present output signal may be about 4.4 μA, about 4.9 μA, etc.

Figure 3:
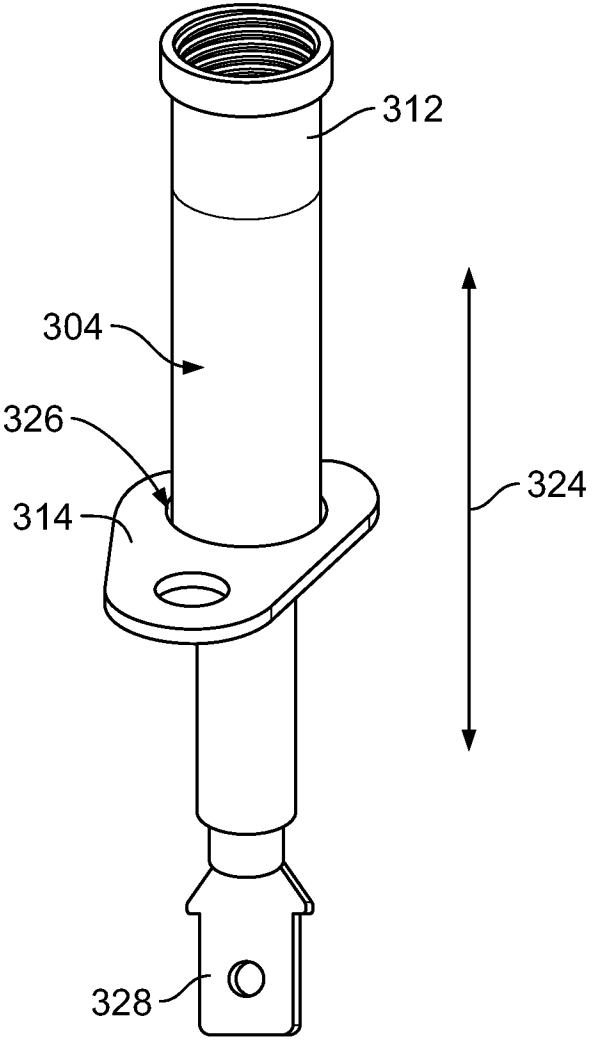
FIG. 3 is an orthogonal view of an example flame sensor body for use with the flame sensor assembly of FIG. 1.

FIG. 3 illustrates an example flame sensor body 304, which may be used with the flame sensor assembly 100 of FIG. 1. The flame sensor body 304 includes a cylindrical body having a longitudinal axis 324, and an adjustable bracket 314. As shown in FIG. 3, the adjustable bracket 314 may be a teardrop bracket defining an opening 326 through which the cylindrical body 304 is received.

The teardrop bracket 314 may be movable to multiple positions along the longitudinal axis 324 of the cylindrical body 304, and may be adapted to clamp at one of multiple positions along the longitudinal axis 324 to inhibit movement of the teardrop bracket 314 while the teardrop bracket 314 is clamped. Adjusting the teardrop bracket 314 may allow a field service technician to position the flame sensor body 304 at an appropriate location in the flame sensor assembly 100, so the flame sense rod 102 is positioned properly adjacent the flame of the heating device.

The flame sensor body 304 may include any suitable material, such as a ceramic body, etc. The receptacle 312 may be located at a first end of the flame sensor body. The flame sensor body 304 may further include a spade connector 328 located at a second end of the flame sensor body 304 opposite the receptacle 312.

For example, the receptacle 312 may receive the coupling end 110 of the flame sense rod 102, and the spade connector 328 may connect to the wiring adapter 106. In other embodiments, the adjustable bracket 314 may have a shape other than a teardrop bracket, the flame sensor body 304 may connect to the wiring adapter 106 using a connector other than a spade connector 328, etc.

The flame sensor body 304 may have a thread lock material (e.g., grease, paste, adhesive, etc.) disposed on the body 304, such as in the receptacle 312, to maintain proper coupling of the flame sense rod 102 to the flame sensor body 304. In some embodiments, a dielectric assembly accessory may be coupled to the flame sensor body 304 (e.g., a universal flame sensor assembly kit may include a tube of thread lock, one or more dielectric assembly accessories, etc.). For example, the thread lock material may inhibit degradation of the mechanical joint between the flame sensor body 304 and the flame sense rod 102, to maintain a sufficient electrical path from the flame sense rod 102 to the flame sensor body 304. Because the flame sense current may be relatively small, the thread lock material, dielectric assembly accessories, etc., may inhibit loss of connection for the relatively small low flame current signals based on degradation of the mechanical joint between the flame sensor body 304 and the flame sense rod 102 over time, may inhibit rotation of the flame sense rod 102 due to vibration, etc.

Figure 4A:
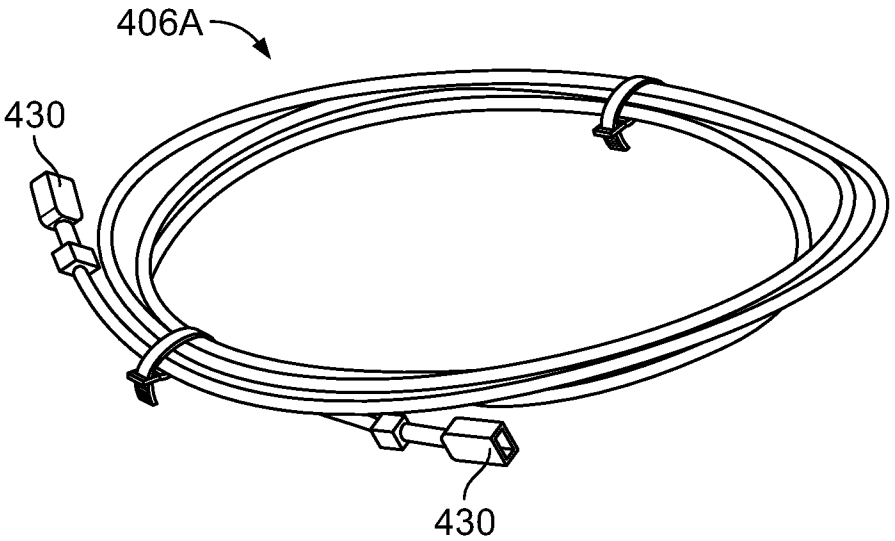
FIGS. 4A and 4B are top views of different example wiring adapters for use with the flame sensor assembly of FIG. 1.
Figure 4B:
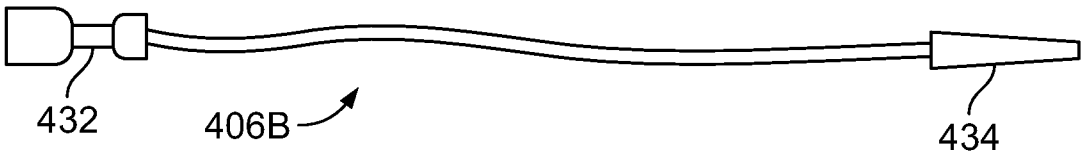

FIGS. 4A and 4B illustrate two different wiring adapters 406A and 406B. As shown in FIG. 4A, the wiring adapter 406A may include two connectors 430 that are identical to one another at each end of the wiring adapter 406A. As shown in FIG. 4B, the wiring adapter 406B includes two connectors 432 and 434 that are different than one another.

The different connectors 430, 432, 434 of the different wiring adapters 406A and 406B may correspond to different OEM configurations, allowing a field service technician to select an appropriate one of the wiring adapters 406A and 406B for a given OEM assembly replacement. For example, the wiring adapters 406A and 406B may connect directly to a furnace control (e.g., when the flame sense signal connector is part of a furnace control board), the wiring adapters 406A and 406B may connect to a flame sensor wiring plug in a wiring bundle in a furnace where the wiring bundle connects to the furnace control board, etc.

For example, the connectors 430 of the wiring adapter 406A may connect to a first type of OEM flame sense signal connector, and the connectors 432 or 434 of the wiring adapter 406B may connect to a different type of OEM flame sense signal connector. Each wiring adapter 406A and 406B may be connected to couple the flame sensor body 104 of FIG. 1 to an appropriate flame sense signal connector, and may be removable to connect a different wiring adapter as desired. Although FIGS. 4A and 4B illustrate two wiring adapters 406A and 406B, other embodiments may include more or less than two wiring adapters (e.g., a universal flame sensor replacement kit may include more or less than two wiring adapters), each wiring adapter may include other connectors, etc.

Figure 5:
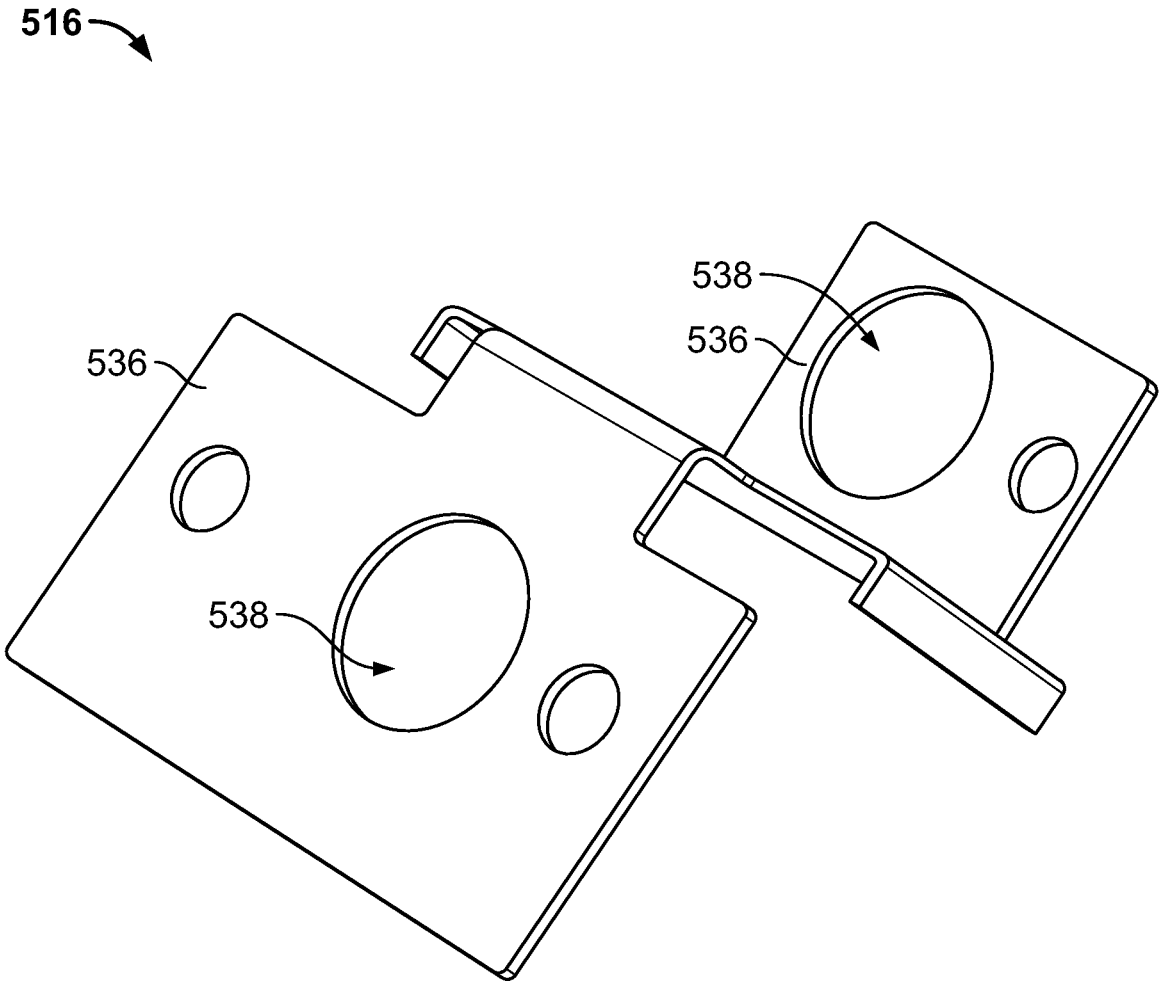
FIG. 5 is an orthogonal view of an example mounting bracket for use with the flame sensor assembly of FIG. 1.

FIG. 5 illustrates an example mounting bracket 516, which may be used in the flame sensor assembly 100 of FIG. 1. As shown in FIG. 5, the mounting bracket 516 includes multiple mounting surfaces 536. Each mounting surface 536 defines multiple openings 538 for mounting the mounting bracket 516 to different heating devices.

The different mounting surfaces 536 and defined openings 538 may allow a field service technician to mount the flame sensor assembly 100 in a variety of configuration locations with respect to different heating device surfaces. For example, an appropriate mounting surface 536 and defined opening 538 may be selected by a field technician to correspond to a failed OEM sensor assembly mount, so the flame sense rod 102 will be positioned adjacent the flame when the flame sensor assembly 100 is mounted to the heating device.

The flame sensor assembly 100 may be included in any suitable heating device system, such as an HVAC system component, a gas furnace, a boiler, a commercial gas dryer, commercial food equipment such as a fryer, a gas pool heater, etc. For example, an HVAC system may include the flame sensor assembly 100, and at least one gas furnace device having a flame burner. The flame sense rod 102 of the flame sensor assembly 100 may be adapted to detect whether a flame of the heating device is present.

According to another example embodiment of the present disclosure, a method of replacing a flame sensor assembly for a heating device is disclosed. The method may include connecting a flame sense rod to a flame sensor body, where the flame sense rod includes a flame sensor end and at least one thread at an end of the flame sense rod opposite the flame sensor end, the flame sensor body defines a receptacle for receiving the at least one thread of the flame sense rod, and the flame sensor body includes an adjustable positioning bracket.

The method may include connecting a wiring adapter to the flame sensor body for connection with a flame sense signal connector, and mounting the flame sensor body to a heating device using a mounting bracket, with the flame sensor end of the flame sense rod positioned adjacent a flame of the heating device.

In some embodiments, connecting the flame sense rod to the flame sensor body includes screwing the at least one thread of the flame sense rod into the receptacle of the flame sensor body. The flame sense rod may be a first flame sense rod, and the method may further include disconnecting the first flame sense rod from the flame sensor body by unscrewing the first flame sense rod from the receptacle of the flame sensor body, and connecting a second flame sense rod to the flame sensor body by screwing the second flame sense rod into the receptacle of the flame sensor body, wherein a shape of the second flame sense rod is different than a shape of the second flame sense rod.

The method may include positioning the flame sensor end of the flame sense rod adjacent the flame of the heating device prior to mounting the flame sensor body to the heating device. Mounting the flame sensor body may include determining an orientation of the mounting bracket that facilitates positioning the flame sensor end of the flame sense rod adjacent the flame of the heating device, prior to mounting the flame sensor body to the heating device.

Connecting the wiring adapter to the flame sensor body may include determining which one of multiple wiring adapters includes a wiring connector type corresponding to the flame sense signal connector, and connecting the determined one of the multiple wiring adapters between the flame sensor body and the flame sense signal connector.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A flame sensor assembly comprising:

a flame sense rod, the flame sense rod including a flame sensor end and at least one coupling end opposite the flame sensor end;

a flame sensor body, the flame sensor body defining a receptacle for receiving the coupling end of the flame sense rod, the flame sensor body including an adjustable positioning bracket;

a wiring adapter for connecting the flame sensor body with a flame sense signal connector; and a mounting bracket adapted to mount the flame sensor body to a heating device, with the flame sensor end of the flame sense rod positioned adjacent a flame of the heating device.

2. The flame sensor assembly of claim 1, wherein:

the flame sense rod is a first flame sense rod; and the first flame sense rod is removable from the flame sensor body to insert a second flame sense rod, the second flame sense rod having a different shape than the first flame sense rod.

3. The flame sensor assembly of claim 2, wherein the first flame sense rod and the second flame sense rod are removable from the flame sensor body to insert a third flame sense rod, the third flame sense rod having a different shape than the first flame sense rod and the second flame sense rod.

4. The flame sensor assembly of claim 1, wherein:

the flame sense rod includes a first portion and a second portion;

the first portion includes the flame sensor end;

the second portion includes the at least one coupling end; and the first portion is bent at an angle with respect to the second portion.

5. The flame sensor assembly of claim 4, wherein the angle is a ninety degree angle.

6. The flame sensor assembly of claim 1, wherein:

the coupling end of the flame sense rod comprises at least one male thread; and the receptacle of the flame sensor body includes at least one female thread to receive the at least one male thread of the flame sense rod.

7. The flame sensor assembly of claim 1, wherein:

the flame sensor body comprises a ceramic, cylindrical body including a longitudinal axis; and the adjustable bracket comprises a teardrop bracket defining an opening through which the cylindrical body is received, the teardrop bracket movable to multiple positions along the longitudinal axis of the cylindrical body.

8. The flame sensor assembly of claim 7, wherein the teardrop bracket is adapted to clamp at one of the multiple positions along the longitudinal axis to inhibit movement of the teardrop bracket while the teardrop bracket is clamped.

9. The flame sensor of claim 1, wherein the flame sense rod is coupled to the flame sensor body via one of a threaded connection, a bayonet twist lock connection and a push-in spring load connection.

10. The flame sensor of claim 1, wherein the receptacle is located at a first end of the flame sensor body, the flame sensor body further comprising a spade connector located at a second end of the flame sensor body opposite the first end of the flame sensor body.

11. The flame sensor assembly of claim 1, wherein the mounting bracket includes multiple mounting surfaces, each mounting surface defining multiple openings for mounting the mounting bracket to different heating devices.

12. The flame sensor assembly of claim 1, wherein:

the flame sense signal connector is a first flame sense signal connector;

the wiring adapter is a first wiring adapter having a first wiring connector type for connection to the first flame sense signal connector; and the first wiring adapter is removable from the flame sensor body to connect a second wiring adapter to the flame sensor body, the second wiring adapter having a second wiring connector type different than the first wiring connector type, to connect the second wiring adapter to a second flame sense signal connector different than the first flame sense signal connector.

13. The flame sensor assembly of claim 1, wherein the flame sensor is adapted to generate a flame sensor reading current value between two μA and six μA.

14. A heating system device comprising the flame sensor assembly of claim 1, wherein the heating system device comprises one of an HVAC system component, a boiler, a commercial gas dryer, a food preparation device, and a gas pool heater.

15. A method of replacing a flame sensor assembly for a heating device, the method comprising:

connecting a flame sense rod to a flame sensor body, the flame sense rod including a flame sensor end and a coupling end opposite the flame sensor end, the flame sensor body defining a receptacle for receiving the coupling end of the flame sense rod, the flame sensor body including an adjustable positioning bracket;

connecting a wiring adapter to the flame sensor body for connection with a flame sense signal connector; and mounting the flame sensor body to a heating device using a mounting bracket, with the flame sensor end of the flame sense rod positioned adjacent a flame of the heating device.

16. The method of claim 15, wherein connecting the flame sense rod to the flame sensor body includes screwing the coupling end of the flame sense rod into the receptacle of the flame sensor body.

17. The method of claim 16, wherein the flame sense rod is a first flame sense rod, the method further comprising:

disconnecting the first flame sense rod from the flame sensor body by unscrewing the first flame sense rod from the receptacle of the flame sensor body; and connecting a second flame sense rod to the flame sensor body by screwing the second flame sense rod into the receptacle of the flame sensor body, wherein a shape of the second flame sense rod is different than a shape of the second flame sense rod.

18. The method of claim 15, further comprising positioning the flame sensor end of the flame sense rod adjacent the flame of the heating device prior to mounting the flame sensor body to the heating device.

19. The method of claim 18, wherein mounting the flame sensor body includes determining an orientation of the mounting bracket that facilitates positioning the flame sensor end of the flame sense rod adjacent the flame of the heating device, prior to mounting the flame sensor body to the heating device.

20. The method of claim 15, wherein connecting the wiring adapter to the flame sensor body includes:

determining which one of multiple wiring adapters includes a wiring connector type corresponding to the flame sense signal connector; and connecting the determined one of the multiple wiring adapters between the flame sensor body and the flame sense signal connector.

* * * * *